US006179676B1

(12) United States Patent
Wilborn et al.

(10) Patent No.: US 6,179,676 B1
(45) Date of Patent: Jan. 30, 2001

(54) SHOCK TOWER

(76) Inventors: Jon D. Wilborn, 3351 Vankton, Claremont, CA (US) 91711; Michael Murphy, 22981 Sierra Trail, Canyon Lake, CA (US) 92587

( * ) Notice: Under 35 U.S.C. 154(b), the term of this patent shall be extended for 0 days.

(21) Appl. No.: 09/453,658

(22) Filed: Dec. 3, 1999

Related U.S. Application Data

(60) Provisional application No. 60/125,474, filed on Mar. 22, 1999.

(51) Int. Cl.[7] ..... B63B 1/00; B63B 35/85

(52) U.S. Cl. ..... 441/72; 441/65

(58) Field of Search ..... 114/274, 279, 114/363; 441/65, 72

(56) References Cited

U.S. PATENT DOCUMENTS

| | | | | |
|---|---|---|---|---|
| D. 261,022 | | 9/1981 | Hoskins . | |
| 2,452,280 | | 10/1948 | Zahller . | |
| 2,707,986 | | 5/1955 | Johnson . | |
| 2,721,088 | | 10/1955 | Ritter, Jr. . | |
| 3,325,179 | | 6/1967 | Bissett . | |
| 4,014,283 | | 3/1977 | Crnogorac . | |
| 4,193,609 | | 3/1980 | Bissett . | |
| 4,260,036 | | 4/1981 | Bissett . | |
| 4,421,193 | | 12/1983 | Bissett . | |
| 5,249,998 | | 10/1993 | Woolley et al. . | |
| 5,309,861 | * | 5/1994 | Mardikian | 114/363 |
| 5,329,870 | | 7/1994 | Cook . | |
| 5,367,978 | * | 11/1994 | Mardikian | 114/363 |
| 5,518,080 | | 5/1996 | Pertile . | |
| 5,603,281 | | 2/1997 | Harvey et al. . | |
| 5,911,191 | * | 6/1999 | Burer | 114/363 |

* cited by examiner

*Primary Examiner*—Russell D. Stormer
*Assistant Examiner*—Patrick Craig Muldoon
(74) *Attorney, Agent, or Firm*—Joseph E. Mueth

(57) ABSTRACT

A water sport device for supporting a seated human rider while the rider and the device are towed behind a powered water craft, including an elongate board to which a seat and foot holder are secured, an elongate hydrofoil extending downward from the board and a planing blade secured to the hydrofoil generally parallel to the board so that the planing blade provides essentially no lift when the board is horizontal. The seat is secured to the board by a shock absorbing means to cushion the impact forces on the rider. The positioning of the seat and the planing blades at the rear of the board, the use of a single vertical hydrofoil, the size of the planing blade and the positioning of the foot holders at least two feet in front of the seat provides a water sports device which is relatively easy to ride, while at the same time being highly maneuverable and capable of high jumps.

4 Claims, 5 Drawing Sheets

24
92
38
58
90
30
26
34
14
28
20
32
72
12
10
68
16
70
18
86
82
84

SHOCK TOWER

This patent application claims the filing date of U.S. Provisional patent Application Ser. No. 60/125,474, filed Mar. 22, 1999.

BACKGROUND OF INVENTION

U.S. Pat. No. 5,100,354 and U.S. Pat. No. 5,249,998 disclose a water sport device for supporting a seated human rider while the rider and the device are towed behind a powered water craft. The device includes an elongated board to which a rigidly mounted seat and foot holders are secured. An elongate strut or arm projects downwardly from the board and a planing blade is secured to the arm generally parallel to the board. The positioning of the seat and the planing blade provides essentially no lift when the board is horizontal. The positioning of the rigidly mounted seat and the planing blades at the rear of the board, the use of a single vertical strut, the size of the planing blade and the positioning of the foot holders at least two feet in front of the seat provides a water sports device which is relatively east to ride, while at the same time being highly maneuverable and capable of high jumps.

SUMMARY OF INVENTION

In a water sports device for supporting a seated human rider while the rider and the device are towed behind a powered water craft, the device including an elongated board having a front end and a back end to which is secured a seat for supporting the buttocks of the rider in a position spaced from and roughly centered above the back one-third of the board, a holder for securing at least one foot of the rider over the top of the board secured to the board spaced at least two feet toward the front end of the board from the seat, an elongated hydrofoil extends downward from the board and a planing blade secured to the hydrofoil spaced from the board, so as to be generally parallel to the board so that the planing blade provides essentially no lift when the board is horizontal;

the improvement wherein said seat is secured to said board by a shock absorbing support means to cushion the impact on the rider as the device impacts the water.

In a method for a human rider to jump out of the water on a water sports device while said device is towed behind a powered watercraft, said device including a member having a front end and a back end, a seat secured to said member and a blade generally parallel and fixed below said member, said blade having an angle of attack with respect to the surface of the water when towed behind a watercraft said method comprising:

positioning the buttocks of said rider in said seat;

securing at least one foot of said rider to said member toward the front end of said member from said seat forward of said planing blade; and leaning backward, and thus lifting said at least one foot and, thus said front end of said member and said planing blade to change said angle of attack of said blade, causing said member and said rider to jump out of said water;

the improvement wherein said seat is secured to said board by a shock absorbing support means to cushion the impact on the rider as the device impacts the water.

In the prior art devices, the seat is rigidly connected to the board so that upon impact with the water, the full brunt of the force slamming the board onto the water is transmitted to the rider. This repetitive force is tiring and painful to the rider.

The present invention overcomes this problem while at the same time maintaining the same constant spatial relationship between the seat and the board so that the ride balance and overall landing characteristics of the device are never disturbed.

DESCRIPTION OF THE PREFERRED EMBODIMENT

Turning to the drawings in greater detail.

Figure 1:
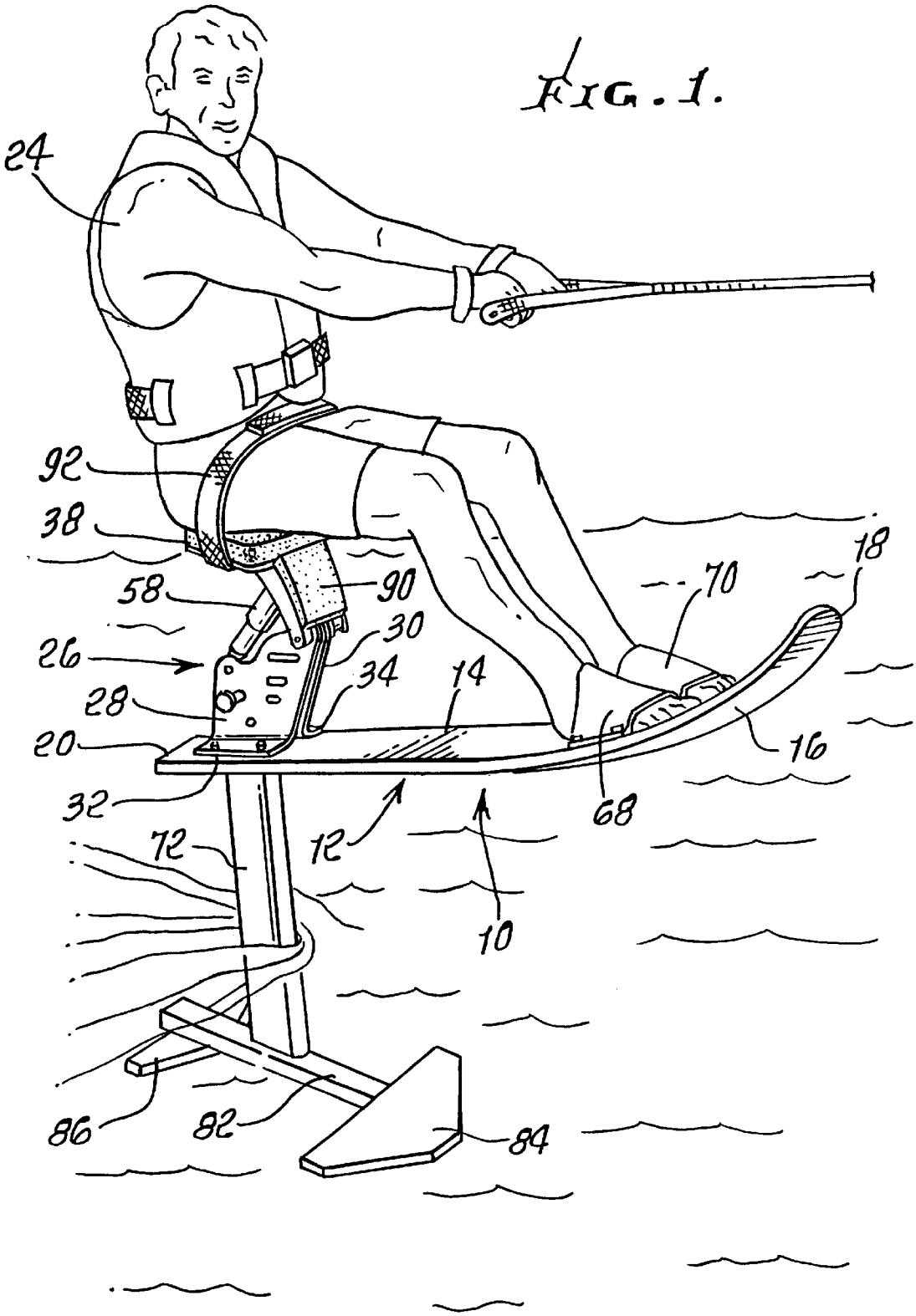
FIG. 1 is a perspective view illustrating a human rider seated on the device of the present invention while being towed behind a powered watercraft (not shown).

Referring to FIG. 1, there is shown a "flying ski" 10 which embodies the preferred design of the water sports device present invention. The flying ski 10 includes an elongate board 12 having an upper surface 14 and a lower surface 16, and a front end 18 and a back end 20. A seat 22 extends generally perpendicular to and upward from the upper surface 14 of the board for supporting the buttocks of a seated rider 24 at a point spaced above the back of the board.

The seat 22 is carried by the shock absorbing tower or mechanism 26. The shock absorbing mechanism 26 includes two spaced apart metal supporting members 28, 30, each having integral flanges 32, 34 projecting at right angles at their lower ends for attachment to the board 10 by threaded bolts 36.

The seat 22 is formed by a resilient foam cushion 38 which is adhered by, for example, an adhesive to seat supporting means 40. The seat supporting means 40 integrally includes the seat plate 42 welded to a pair of spaced apart rigid downwardly, forwardly curving beams 44. Each of the beams 44 is formed of two closely spaced matched rigid members 46. The beams 44 are rotatably attached to the upper extremities of the supporting members 28, 30 by a through shaft 48 which also passes through spacers 50, 52, 54 and 56.

The shock absorbing tower further includes a Risse racing shock absorber 58 which is connected to the underside of the beams 44 by shaft 60 and retainers 62. The bottom end of shock absorber 58 is connected to supporting members 28, 30, by shaft 64 and retainers 66.

Figure 2:
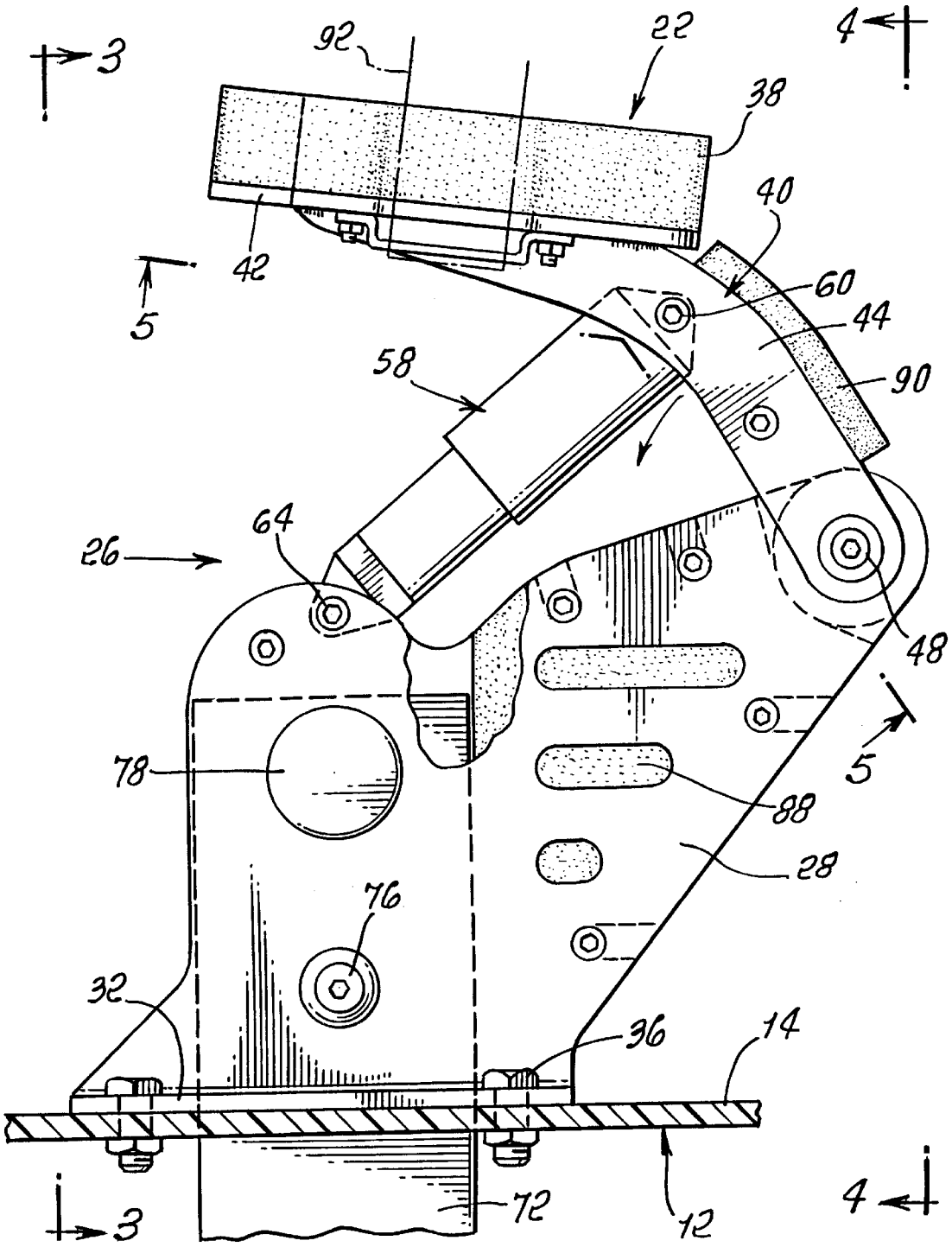
FIG. 2 is a side plan view of the support mechanism for the seat according to this invention.
Figure 3:
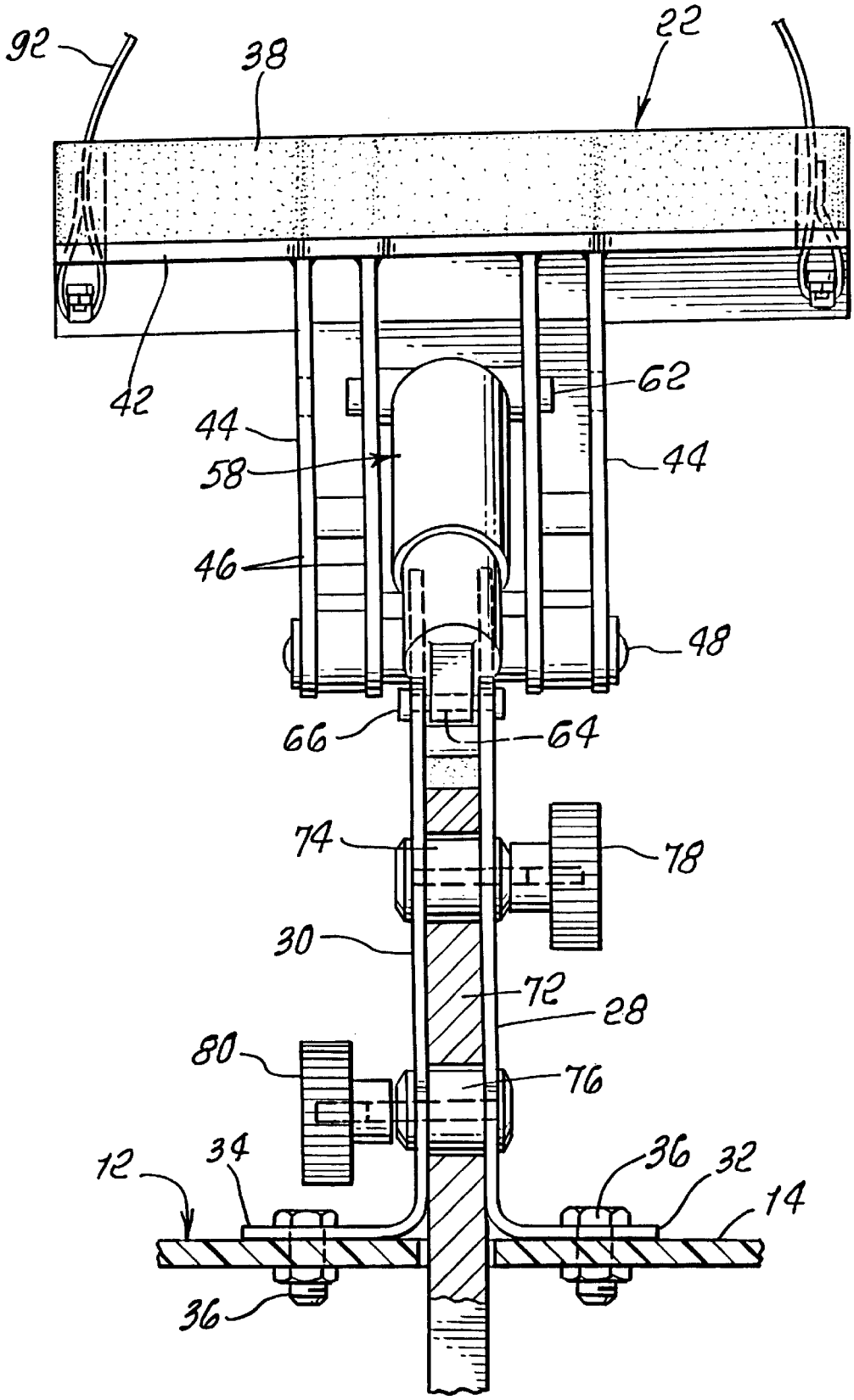
FIG. 3 is a rear view taken along the line 3—3 in FIG. 2.
Figure 4:
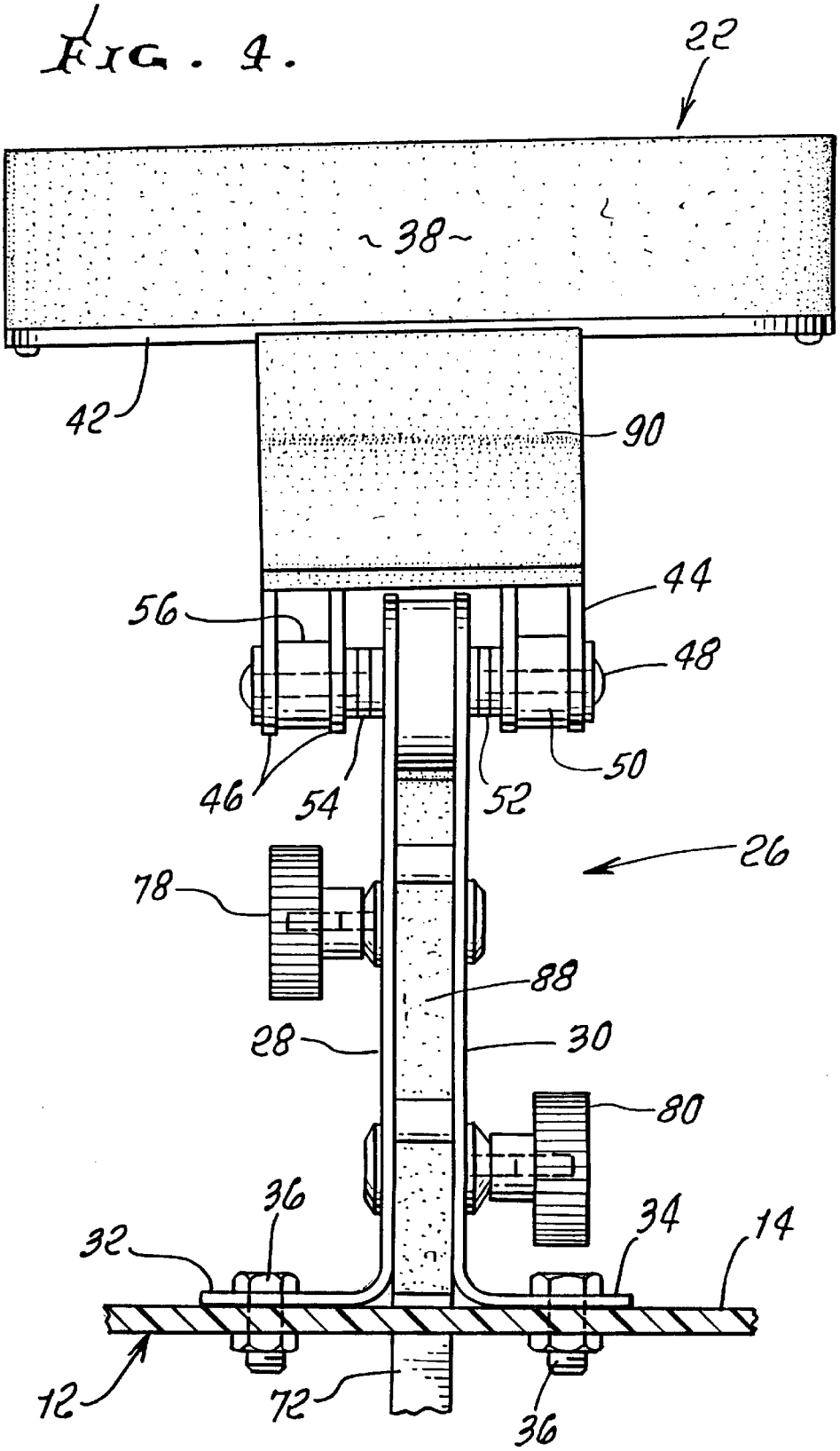
FIG. 4 is a front view taken along the line 4—4 in FIG. 2.
Figure 5:
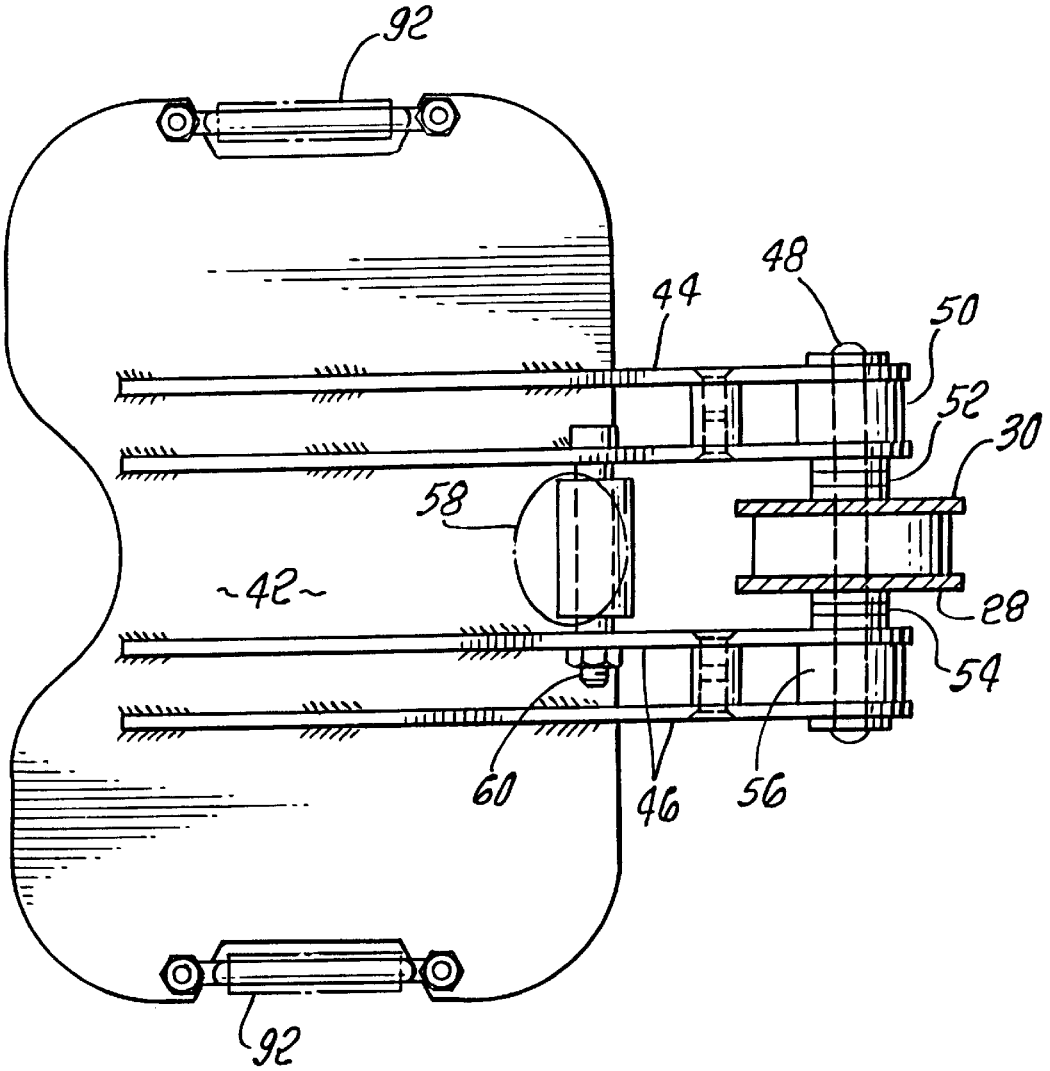
FIG. 5 is a view taken along the line 5—5 in FIG. 2.

Thus, the entire seat assembly can, upon impact with the water while under the weight of the rider on the seat, controllably move about shaft 48 with energy being absorbed by shock absorber 58, as indicated by the arrow in FIG. 2. The ultimate connection of the seat 22 to shaft 48 maintains the leading edge of the seat at a fixed distance from the board 10.

The rider's legs extend forward toward the front of the board, where they are secured by a holders 68, such as a pair of rubber sheets 70, which are attached to the front end 18 of the board so as to form two elongate generally semicircular loops into which the feet of the rider can be inserted.

An elongate hydrofoil 72 extends generally perpendicular to and thru a tight fitting opening in the board 10. The portion of hydrofoil 72 extending below the board 12 is of a water foil shape in cross section. The upper end of the hydrofoil 72 extends upwardly through the opening in board 10 and is generally configured to be received between the supporting member 28, 30. The cross-members 74 and 76 pass through holes in the upper end of hydrofoil 72. The cross members 74 and 76 are provided with tightening means 78 and 80 which also creates a clamping action on the upper portion to tightly grip and hold the hydrofoil 72 in alignment. An elongate support 82 having a forward end and rearward end is fixed to the bottom end of the hydrofoil 72 at a point just forward of the middle of the support 82. A forward planing blade 84 is secured to the top of the forward end 12 of the support 82 so as to be generally parallel to the board 12. Likewise, a rear planing blade 86 is secured to the bottom of the rearward end of the support 82 generally parallel to the board 12. A pair of vertical fins can be secured to the bottom of the rear planing blade 86 on either side of the support 82. The planing blade structure (i.e., the hydrofoil 72, the support 82, the forward planing blade 84, the rear planing blade 86), provides essentially no lift when the board 12 is horizontal.

The flying ski 10 and rider are desirably towed behind a standard powered water craft utilizing a standard ski tow rope, the handle of which is held by the rider (as illustrated in FIG. 1) at a point spaced roughly above the knees of the rider.

Plastic foam 88 is preferably sandwiched between the leading edges of supporting members 28, 30, to prevent water from rushing there between and possibly creating unwanted forces on the seat support.

The auxiliary foam piece 90 is intended to prevent undesirable impact between the hard metal surfaces of the seat support and the rider.

The water sports device is preferably provided with a seat belt 92 for securing the buttocks of the rider to the seat to protect the rider from being struck by the device in the event of a fall.

The shock absorbing means is effective in reducing wear and tear on board 12, hydrofoil 72, and the planing blades 84 and 86 and all connective structure. The effects of pounding on the water are substantially reduced.

Having fully described the invention, the following claims are intended to particularly point out and distinctly claim the invention.

We claim:

1. In a water sports device for supporting a seated human rider while the rider and the device are towed behind a powered water craft, the device including an elongated board having a front end and a back end to which is secured a seat for supporting the buttocks of the rider in a position spaced from and roughly centered above the back one-third of the board, a holder for securing at least one foot of the rider over the top of the board secured to the board spaced at least two feet toward the front end of the board from the seat, an elongated hydrofoil extends downward from the board and a planing blade secured to the hydrofoil spaced from the board, so as to be generally parallel to the board so that the planing blade provides essentially no lift when the board is horizontal;

the improvement wherein said seat is secured to said board by a shock absorbing support means to cushion the impact on the rider as the device impacts the water, the shock absorbing support means including a shock absorbing tower having means to maintain the leading edge of the seat at a fixed distance from said elongated board while allowing the balance of the seat to move generally up and down under the weight of the rider in response to the force of impact of the elongated board on the surface of the water.

2. The water sports device of claim 1, further comprising a seat belt for securing the buttocks of said rider to said seat to protect said rider from being struck by said device in the event of a fall.

3. The water sports device of claim 1, wherein said planing blade is positioned below said board at least as far back as the back one-quarter of said board.

4. The water sports device of claim 1, wherein said planing blade extends behind the back end of said board.

* * * * *